US006178999B1

(12) United States Patent
Renaud

(10) Patent No.: US 6,178,999 B1
(45) Date of Patent: Jan. 30, 2001

(54) FUEL SUPPLY ADAPTER

(75) Inventor: Patrick Renaud, Brossard (CA)

(73) Assignee: Wildfire Fire Equipment, Inc., Lachine (CA)

( * ) Notice: Under 35 U.S.C. 154(b), the term of this patent shall be extended for 0 days.

(21) Appl. No.: 09/294,135

(22) Filed: Apr. 20, 1999

(51) Int. Cl.[7] ..... E03B 11/16
(52) U.S. Cl. ..... 137/590; 137/565.01; 251/149.6
(58) Field of Search ..... 137/590, 565.01; 251/149.6

(56) References Cited

U.S. PATENT DOCUMENTS 1,846,877 * 2/1932 Knapp ..... 251/149.6
3,510,102 * 5/1970 Sungaila ..... 137/590
4,494,570 * 1/1985 Adkins ..... 137/590
4,590,964 * 5/1986 Beardmore ..... 137/565

* cited by examiner

*Primary Examiner*—A. Michael Chambers
(74) *Attorney, Agent, or Firm*—Nixon & Vanderhye, PC; Frank P. Presta

(57) ABSTRACT

A fuel supply adapter for pumping fuel out of fuel cans through a pump. The adapter is shaped to fit in the pouring neck of the fuel can and be secured therein. The adapter has a U-shaped cross-section with a thick bottom portion and a hollow top portion, and a connector is located inside the top portion so it does not interfere with the closing of the cap of the fuel can. Radial gripping pins are provided inside the bore the handle the adapter.

20 Claims, 3 Drawing Sheets

FUEL SUPPLY ADAPTER

FIELD OF THE INVENTION

The present invention relates to a fuel supply adapter for fuel cans such as transportable metal or plastic cans.

BACKGROUND

Fuel cans are used to transport fuel to remote locations, for example for military or fire fighting applications. Cans known in the art are made of metal or plastic, and have pouring necks with inner threads adapted to receive a pouring spout, and outer threads for receiving a closing cap. To deliver fuel to an engine having a fuel supply pump, it is necessary to either transfer the fuel to a can already provided with the appropriate adapter, drill a hole in the top surface of the fuel transport can and install an adapter in the hole, or install a separate adapter over the pouring neck of the can. This latter type of adapters is usually fitted on the outer threads of the pouring neck, and thereby need to be transported apart from the can and installed after the cap has been removed. In each of the above cases, accessories need to be carried apart from the can and the fuel cannot be readily supplied in case of an emergency.

OBJECT AND SUMMARY OF THE INVENTION

It is therefore an object of the present invention to provide a fuel supply adapter for a fuel can that may be transported inside the fuel can.

Another object of the invention is to provide such a fuel supply adapter that may be used with standard existing fuel cans.

Accordingly the present invention provides a fuel supply adapter for pumping fuel out of a fuel can through a fuel pump. The fuel can has a bottom and a pouring neck, and the pouring neck has an inner surface and an outer surface, the outer surface being usually provided with threads.

The adapter includes a generally cylindrical body insertable inside the pouring neck of the fuel can. The cylindrical body has a U-shaped cross-section, which defines a hollow top portion and a closed bottom portion having a predetermined thickness. The top portion has an outer surface provided with means for engagement with the inner surface of the pouring neck.

The adapter further includes connecting means extending through the closed bottom portion. The connecting means have a top extremity for connecting the adapter to the fuel pump, this top extremity projecting inside the top portion. The connecting means also have a lower extremity projecting from the closed bottom portion inside the fuel can when the adapter is inserted inside its pouring neck.

Also included in the adapter is a supply tube connectable to the lower extremity of the connecting means, and having a length sufficient to reach the bottom of the fuel can when the adapter is inserted inside the pouring neck.

Advantageously, the adapter according to the present invention is removably installed inside the pouring neck of the fuel can, and may be transported in this manner with the can itself. Also, it is adapted to be used with fuel cans that already answer to transportation and military standards. In addition, no special tool is required to install or remove the adapter according to the present invention.

The present invention and its advantages will be better understood upon reading the following description of a preferred embodiment thereof, with reference to the accompanying drawings.

DESCRIPTION OF A PREFERRED EMBODIMENT OF THE INVENTION

Figure 1:
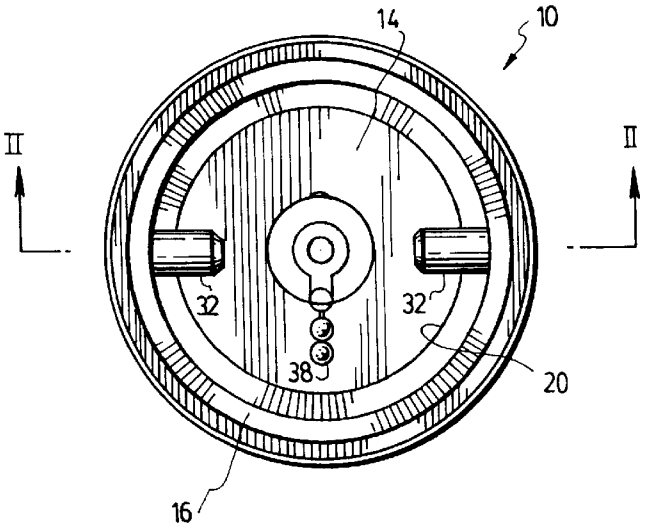
FIG. 1 is a top view of a fuel supply adapter according to a first preferred embodiment of the invention.
Figure 2:
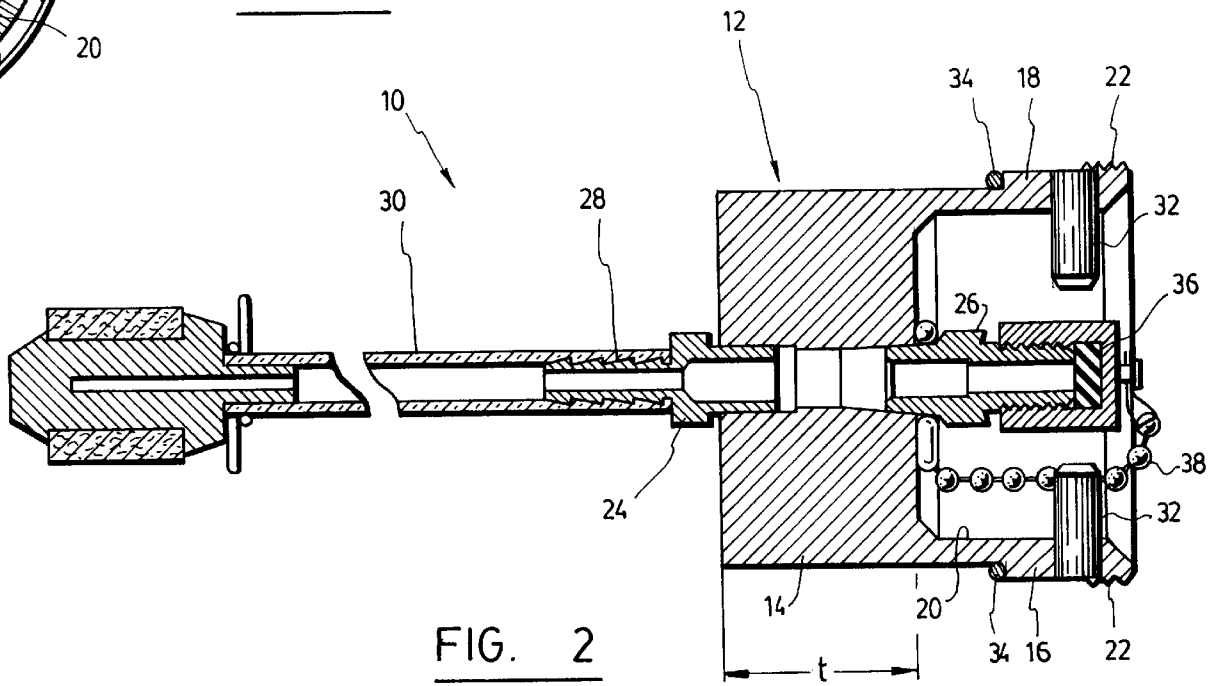
FIG. 2 is a cross sectional view along lines II—II of FIG. 1.

Referring to FIGS. 1 and 2, there is shown a fuel supply adapter 10 according to a first preferred embodiment of the invention.

The adapter 10 has a generally cylindrical body 12, which is insertable into the pouring neck 3 of a standard fuel can 1, the pouring neck 3 having inner threads 2 and outer threads 4. The body has a generally U-shaped cross-section as shown in FIG. 2, defining a bottom portion 14 and a top portion 16. The bottom portion 14 is closed and has a predetermined thickness t. The top portion 16 is hollow, and has an outer surface 18 and an inner side wall 20. The outer surface 18 of the top portion 16 is preferably provided with threads 22, for engagement with the inner threads 2 of the pouring neck 3 of the fuel can 1.

Figure 5:
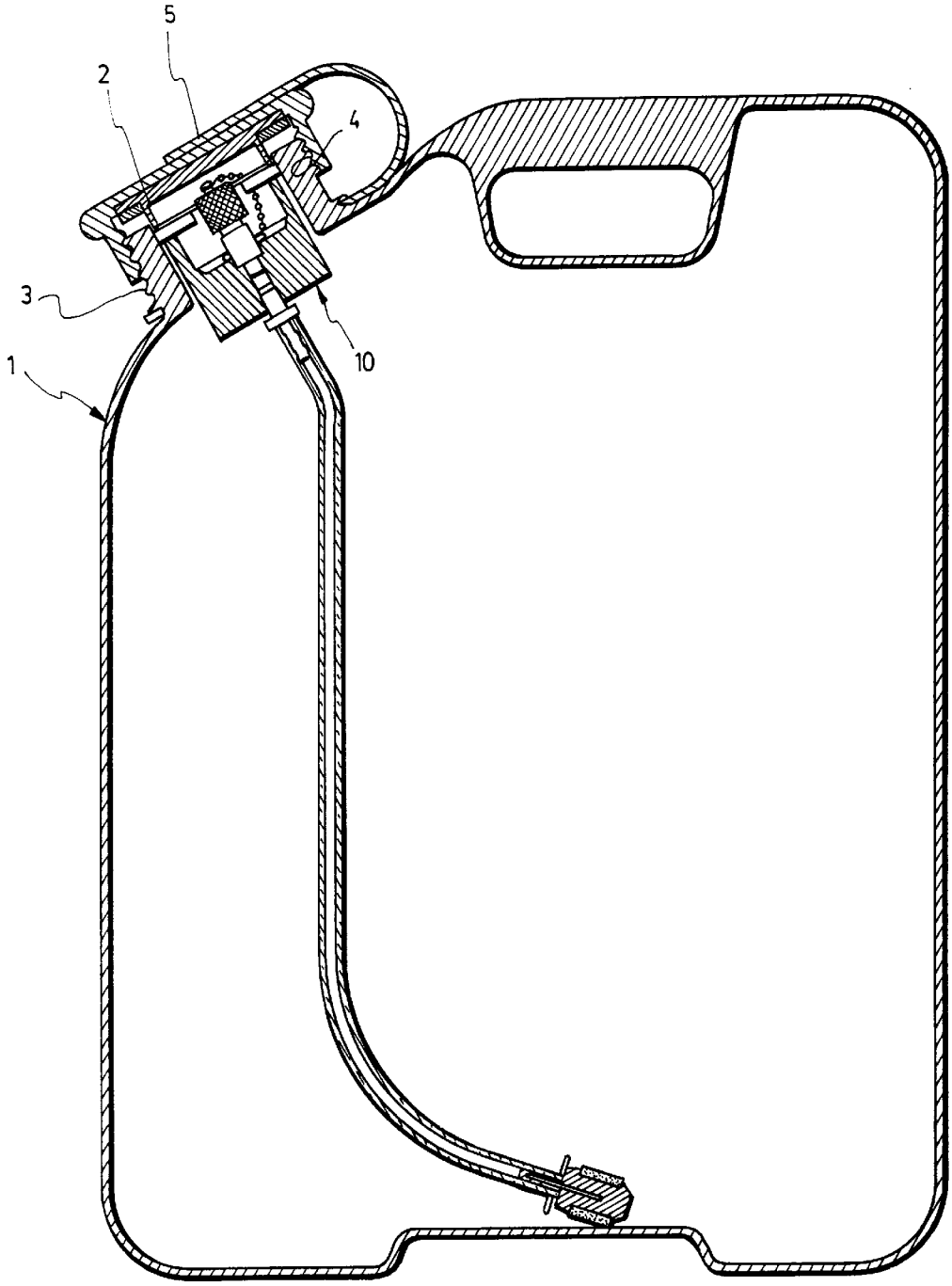
FIG. 5 is a cross sectional view of a fuel supply adapter inserted in the pouring neck of a fuel can.

The adapter 10 includes connecting means, here embodied by connector 24, extending in a longitudinal passage into the bottom portion 14 of the body 12. The connector 24 has a top extremity 26, which is adapted for connecting the adapter 10 to a fuel pump and projects into the top portion 16 of the body 12. No part of the connector 24 extends outside of the confines of the top portion 16, so that it does not interfere with the cap 5 of the fuel can when it is threaded over the pouring neck with the adapter 10 installed inside. The lower extremity 28 of the connector 24 projects from the bottom portion 14, inside the fuel can when the adapter 10 is inserted into its pouring neck 3. A supply tube 30, connectable to the lower extremity 28, is provided to allow access to the fuel inside the can 1, and for this purpose has a length sufficient to reach in operation the bottom of the fuel can (as shown in FIG. 5).

The adapter 10 according to the invention preferably further includes means for inserting and removing it into and out of the pouring neck of the fuel can, these means being here embodied by gripping pins 32, although there could be only one. Each gripping pin 32 projects radially and inwardly of the top portion 14 from the inner side wall 20, on opposite sides of the top portion 14. The gripping pins 32 therefore facilitate handling of the adapter 10 which can be threaded in and out of engagement with the pouring neck by pushing sideways on the gripping pins 32.

Also preferably, the adapter 10 may include a seal 34 fixed around the outer surface of the bottom portion 16 of the body 12. The seal 34 engages with the inside of the pouring neck and prevents water from dripping inside the fuel can and affect the fuel mixture and preferably is an O-ring seal.

The connector 24 can be provided with a cap 36 for covering its top extremity 26 when it is not connected to the fuel pump. The outer surface of the top extremity 26 may thus have threads matching threads on the inner surface of the cap 36 so it can be screwed over the connector 24. Additionally, a chain 38 may be provided, with a first end attached to the cap 36 and a second end attached inside the top portion 14 of the body 12, to keep the cap 36 in proximity to the top extremity 26 of the connector 24 when it is not installed thereon.

Figure 3:
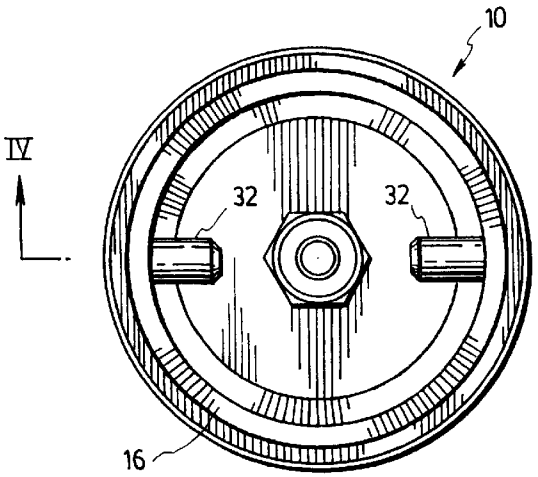
FIG. 3 is a top view of a fuel supply adapter according to a second preferred embodiment of the invention.
Figure 4:
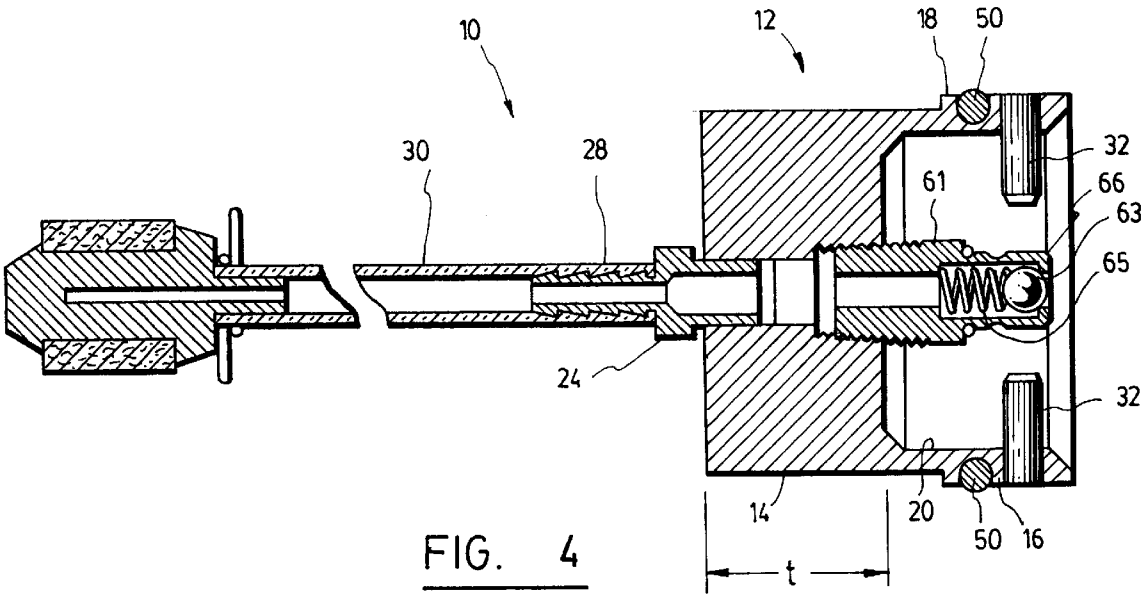
FIG. 4 is a cross sectional view along lines IV—IV of FIG. 3.

In a second preferred embodiment, illustrated in FIGS. 2 and 3, the outer surface 18 of the top portion 16 of the adapter is not provided with threads. Rather, in order to insert and hold the adapter in the pouring neck 3 of the fuel can, there is provided an O-ring seal 50 around the periphery of the outer surface 18 of the top portion 16 of the adapter 10. The O-ring 50 is resilient enough to permit insertion of the adapter 10 inside the pouring neck 3 of the can 3 and yet maintain the adapter 10 in place. It should be noted that in the second preferred embodiment, the adapter also includes means for inserting and removing the adapter in and out of the pouring neck of the fuel can, also embodied by at least one gripping pin 32.

Further, although the following variation could easily be adapted to the first preferred embodiment of the invention, the connecting means include a connector 61 having a top extremity 66, which is adapted for connecting the adapter 10 to a fuel pump and projects into the top portion 16 of the body 12. No part of the connector 61 extends outside of the confines of the top portion 16, so that it does not interfere with the cap 5 of the fuel can when it is threaded over the pouring neck with the adapter 10 installed inside. The lower extremity 28 of the connector 61 projects from the bottom portion 14, inside the fuel can when the adapter 10 is inserted into its pouring neck 3. A supply tube 30, connectable to the lower extremity 28, is provided to allow access to the fuel inside the can 1, and for this purpose has a length sufficient to reach in operation the bottom of the fuel can (as shown in FIG. 5). The connector 61, instead of being threaded as in the first preferred embodiment, includes a ball check-valve 63, outwardly biased by spring 65. Accordingly, the connector serves to connect the fuel can 1 to a pump through a standard push-connector, which pushes the check valve inwardly, and secures itself around the connector 61.

In the preferred embodiments, the cylindrical body 12 is made of aluminum, the connector is made of brass and the supply tube is made of polyurethane. However, any other appropriate materials may alternatively be used for any of the components of the adapter 10.

Of course, numerous changes could be made to the preferred embodiment disclosed hereinabove without departing from the scope of the invention as defined in the appended claims.

What is claimed is:

1. A fuel supply adapter for pumping fuel out of a fuel can through a fuel pump, the fuel can having a bottom and a pouring neck, the pouring neck having an inner surface and an outer surface, the adapter comprising:

a generally cylindrical body insertable inside the pouring neck of the fuel can, said cylindrical body having a U-shaped cross-section defining a hollow top portion and a closed bottom portion having a predetermined thickness, said adapter having an outer surface provided with means for engagement with the inner surface of the pouring neck;

connecting means extending through the closed bottom portion, having a top extremity for connecting the adapter to the fuel pump, the top extremity projecting inside the top portion, and a lower extremity projecting from the closed bottom portion inside the fuel can when the adapter is inserted inside the pouring neck thereof; and a supply tube connectable to the lower extremity of the connecting means and having a length sufficient to reach the bottom of the fuel can when the adapter is inserted inside the pouring neck thereof.

2. A fuel supply adapter according to claim 1, wherein said inner surface of said pouring neck is provided with threads and wherein said means for engaging the inner surface of the pouring neck include threads provided on the outer surface of the adapter at the top portion thereof for engagement with said threads of said inner surface of said pouring neck.

3. A fuel supply adapted according to claim 1, further comprising means for inserting and removing the adapter into and out of the pouring neck of the fuel can.

4. A fuel supply adapter according to claim 3, wherein the top portion of the cylindrical body has an inner side wall, and the means for inserting and removing the adapter comprise a first gripping pin projecting radially inwardly from said inner side wall.

5. A fuel supply adapter according to claim 4, wherein the means for inserting and removing the adapter comprise a second gripping pin projecting radially inwardly from the inner side wall of the top portion, opposite the first gripping pin.

6. A fuel supply adapter according to claim 2, wherein the bottom portion of the cylindrical body has an outer surface and the adapter further comprises a seal fixed around said outer surface for engagement with the pouring neck of the fuel can.

7. A fuel supply adapter according to claim 1, wherein the closed bottom portion of the cylindrical body has a generally longitudinal passage therethrough and the connecting means extend in said passage.

8. A fuel supply adapter according to claim 1, further comprising a cap for covering the top extremity of the connecting means.

9. A fuel supply adapter according to claim 8, wherein the top extremity of the connecting means has an outer surface provided with threads, and the cap has an inner surface having threads for screwing said cap over said top extremity of the connecting means.

10. A fuel supply adapter according to claim 9, further comprising a chain having a first end connected to the cap and a second end attached inside the top portion thereof.

11. A fuel supply adapter according to claim 10, wherein the connecting means, the cap and the chain lie completely inside the top portion of the body.

12. A fuel supply adapter according to claim 4, further comprising:

a cap for covering the top extremity of the connecting means, said top extremity of the connecting means having an outer surface provided with threads, and the cap having an inner surface having threads for screwing said cap over said top extremity of the connecting means; and a chain having a first end connected to the cap and a second end attached inside the top portion thereof.

13. A fuel supply adapter according to claim 12, wherein the connecting means, the gripping pins, the cap and the chain extend completely inside the top portion of the body.

14. A fuel supply adapter according to claim 1, wherein the cylindrical body is made of aluminum.

15. A fuel supply adapter according to claim 1, wherein the top extremity and the lower extremity of the connecting means are made of brass.

16. A fuel supply adapter according to claim 1, wherein the supply tube is made of polyurethane.

17. A fuel supply adapter according to claim 1, wherein said means for engaging said inner surface of said pouring neck include an O-ring secured to the outside surface of said adapter.

18. A fuel supply adapter according to claim 6, wherein said connecting means include a spring-loaded ball check valve at the top extremity thereof.

19. A fuel supply adapter according to claim 17, further comprising means for inserting and removing said fuel adapter in and out of the pouring neck of the fuel can.

20. A fuel supply adapter according to claim 19, wherein the top portion of the cylindrical body has an inner side wall, and the means for inserting and removing the supply adapter comprise at least one gripping pin projecting radially inwardly from said inner side wall.

* * * * *